US005577625A

United States Patent [19]

Baird et al.

[11] Patent Number: 5,577,625

[45] Date of Patent: Nov. 26, 1996

[54] VENTING AND DISPENSING CAP FOR A CONTAINER

[75] Inventors: James C. Baird, Uccle; Johan W. Declerk, Ichtegem; Jorgen Hoernaert, Brugge; Nady Bilani, Strombeek-Bever; Joseph F. Deflander, Wespelaar, all of Belgium

[73] Assignee: The Procter & Gamble Company, Cincinnati, Ohio

[21] Appl. No.: 367,288

[22] PCT Filed: Jul. 2, 1993

[86] PCT No.: PCT/US93/06301

§ 371 Date: Apr. 24, 1995

§ 102(e) Date: Apr. 24, 1995

[87] PCT Pub. No.: WO94/02372

PCT Pub. Date: Feb. 3, 1994

[30] Foreign Application Priority Data

Jul. 18, 1992 [EP] European Pat. Off. ..... 92202223

[51] Int. Cl.[6] ..... B65D 39/00

[52] U.S. Cl. ..... 215/235; 215/270; 215/350; 215/354; 222/212

[58] Field of Search ..... 215/235, 237, 215/260, 270, 307, 311, 349, 350, 352, 354; 220/203.11, 203.12, 366.1; 222/212, 464, 562, 564, 570

[56] References Cited

U.S. PATENT DOCUMENTS

| | | | |
|---|---|---|---|
| Re. 25,765 | 4/1965 | Ankney | 222/570 X |
| 2,980,276 | 4/1961 | Robineau . | |
| 3,047,195 | 7/1962 | Richmond | 222/570 X |
| 3,114,467 | 12/1963 | Montgomery | 215/260 |
| 3,858,756 | 1/1975 | Fulton . | |
| 3,918,611 | 11/1975 | Ewald . | |
| 4,121,728 | 10/1978 | Tagalakis et al. . | |
| 4,480,759 | 11/1984 | Behrens et al. . | |
| 4,629,081 | 12/1986 | McLaren . | |
| 4,646,945 | 3/1987 | Steiner et al. | 222/507 |
| 4,711,372 | 12/1987 | Gach . | |
| 4,776,501 | 10/1988 | Ostrowsky . | |
| 4,982,882 | 1/1991 | Gueret . | |
| 4,993,606 | 2/1991 | Bolen, Jr. et al. . | |
| 5,031,804 | 7/1991 | Conrad | 222/566 |
| 5,056,676 | 10/1991 | Allen et al. . | |
| 5,067,624 | 11/1991 | Thanisch . | |
| 5,165,578 | 11/1992 | Laible | 222/189 |

FOREIGN PATENT DOCUMENTS

| | | |
|---|---|---|
| 31299/57 | 9/1957 | Australia . |
| 41159/58 | 9/1958 | Australia . |
| 32582/63 | 7/1963 | Australia . |
| 4166/66 | 4/1966 | Australia . |
| 60738/80 | 7/1980 | Australia . |
| 86676/82 | 8/1982 | Australia . |
| 2032892 | 5/1980 | United Kingdom . |

*Primary Examiner*—Stephen Cronin
*Attorney, Agent, or Firm*—Ronald W. Kock

[57] ABSTRACT

A cap for a container having a body and a closure. The body has a side wall and an adjoining top. The Side wall has means to let gases escape from the container to ambient. The top has an interior and at least one recess on the interior. The body further has a a line juxtaposed to the interior of the top. The interior and the liner are pierced by a hole through which a tubular part extends from the body. The sealing means maintains the liner pressed against the interior of the top in a leak-tight manner. The closure is a flip-top cap.

3 Claims, 2 Drawing Sheets

VENTING AND DISPENSING CAP FOR A CONTAINER

TECHNICAL FIELD

The present invention relates to a cap for a container for containing liquids. The cap according to the invention allows for the venting of the container as well as the dispensing of said liquid.

BACKGROUND OF THE INVENTION

Containers for containing liquids have been extensively described in the art as well as their numerous possible applications. In particular, many inventions have been made relating to containers for containing liquids which generate pressure, such as bleach-containing compositions. Indeed, specific problems are associated with such liquids, in that the pressure which builds up inside a closed container containing such a liquid may raise safety issues, or lead to the deformation of the container.

In the art, solutions to this problem have been proposed, for instance by designing containers of specific shapes, whereby the container has optimal resistance to pressure build-up, limiting the degree of deformation. This type of solution has the drawback that it limits the flexibility of shape, material selection and material thickness when designing such containers.

Other solutions relate to various venting caps for such containers, which allow the gas generated inside the container to escape. Such caps have been described for instance in GB 2 032 892, where a cap is disclosed which comprises a liner juxtaposed to the top of the cap which allows for pressure relief via a thread in the side of the cap. An improvement to this type of cap is known, where the top of the cap further comprises recesses, whereby the liner flexes into said recess as the pressure inside the container builds up. The flexed liner allows for improved pressure relief over the caps in GB 2 032 892 via the recesses and the thread in the side of the cap.

However, said venting caps have the drawback that the cap has to be removed from the container for the contained liquid to be dispensed. It is thus an object of the present invention to provide a cap which allows for the venting of the container onto which said cap is affixed without the leakage of the liquid contained in the container, and which further allows for the dispensing of said liquid, without said cap having to be removed from said container.

Furthermore, the caps of the prior art are incompatible for use with a container wherein the contained liquid is to be dispensed through a small opening such as a nozzle. It is therefore another object of the present invention to provide a venting and dispensing device which allows for the dispensing of the contained liquid through a small opening while ensuring appropriate venting.

SUMMARY OF THE INVENTION

Referring to FIG.1 and FIG. 2 hereinafter, the present invention is a cap for a container, said cap comprising an interior and an exterior, said cap comprising a body (1) and a closure (2), said body comprising a side wall (3) and an adjoining top (4), wherein said side wall comprises means (5) to let gases through to the ambient, wherein said top comprises at least one recess (6) on the interior, wherein said body further comprises a liner (7) juxtaposed to said interior of said top, characterized in that said top and said liner are pierced by a hole (8), and that said body further comprises a tubular part (9) extending through the hole in said top and said liner, said tubular part having an exterior diameter corresponding to the diameter of said hole, and wherein a sealing means maintains said liner pressed against said interior of said top in a leak-tight manner.

DETAILED DESCRIPTION OF THE INVENTION

Figure 1:
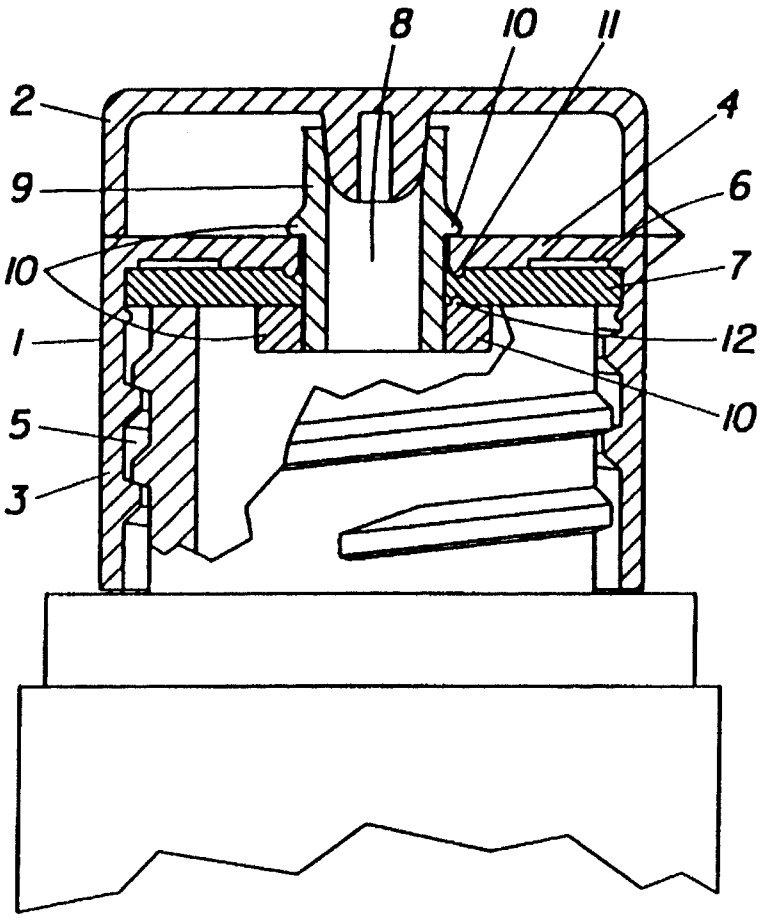
FIG. 1 is a sectioned side elevation view of a cap of the present invention shown threaded onto a container.

The cap according to the present invention comprises an interior and an exterior. Unless otherwise specified, the term "interior" hereinafter refers to what faces the container onto which the cap is to be affixed. The term exterior refers to what faces the ambient. Although not limited thereto, the cap according to the present invention is preferably made of any plastic material available to the man skilled in the art. The cap according to the present invention comprises a body (1) and a closure (2). The body of said cap comprises a side wall (3) and an adjoining top (4).

The side wall (3) of the body comes into contact with the exterior of the neck of the container onto which the cap is affixed. It is essential for the purpose of the present invention that said side wall comprises means (5) to let gases through to the ambient, thereby ensuring pressure relief. The cap according to the present invention can be permanently or removably affixed to the container by a variety of means. Although it is an object of the present invention to provide a cap which allows for dispensing of the product without having to remove the cap from the container, it is nevertheless desirable to have the possibility to remove said cap from the container, for instance when it is needed to dispense large amounts of liquid, or to allow for the container to be refilled. Therefore, the cap may be screwed or snapped onto the container. In a preferred embodiment of the present invention, the cap is screwed onto the container, and said means (5) will therefore be in the form of a screw thread on the interior of said side wall. In other possible embodiments, said means (5) may consist of one or several channels through said side wall (3), or along the interior of said side wall.

An essential element of the cap according to the present invention is that said top of said body comprises at least one recess (6) on the interior. Said recess must be shaped, dimensioned and situated in said face so as to allow for the liner (7) described hereinafter to flex into said recess so as to ensure pressure relief. In a preferred embodiment of the invention, said recess is located on the periphery of the interior of said top. In a preferred embodiment of the invention, there are several recesses arranged at the periphery of the interior of said top.

In a preferred embodiment of the present invention, the interior of said top further comprises catches or a protuberant ring, or any continuous protuberance (11) which come into contact with the liner in a region of said liner which is adjacent to the hole (8) so as to increase the mechanical pressure exerted on the liner, thereby improving the seal between said liner and the interior of said top.

Another essential element of the cap according to the present invention is a liner (7) which is juxtaposed to the interior of said top. Said liner must be impermeable to the liquid contained in the container onto which the cap is affixed, and said liner must be flexible so that it may flex into the recesses in the interior of said top described hereinabove, as the pressure builds up inside said container. However, said liner must also be rigid enough to seal the container making it liquid-tight even if the closed container is inverted. In the cap according to the present invention, said liner is juxtaposed to the interior of said top. The selection of an appropriate material for such liner will depend on the liquid to be contained in the container, and thus will vary in each instance. The critical factors to be met by said material are impermeability and flexibility. Suitable liners for use herein may be made from expanded polyethylene foam, plastic mixtures including ethyl vinyl acetate (EVA), or from rubbers including silicone rubbers.

Another essential element of the cap according to the present invention is that said top of said body and said liner are pierced with a hole (8) in order to allow for the dispensing of the liquid contained in said container. It is one of the advantages of the present invention that the dimensions of said hole are not critical for the purpose of venting. Therefore one can choose the appropriate size for said hole as a sole function of the end use envisioned for the container, i.e. the desired dispensing characteristics. For instance, one can choose to use a small opening such as a nozzle in combination with a squeezable container in order to be able to dispense the contained liquid as a jet.

According to the present invention said body further comprises a tubular part (9) which extends through said hole (8) in said top and said liner. The cross-section of said tubular part may be circular, or alternatively, oval in shape. Said tubular part allows for the liquid contained in the container to be dispensed, and in a preferred embodiment may be designed to provide an integral sealing means to ensure that said liner is pressed against the interior of said top in a leak-tight manner. The tubular part may itself provide the dispensing system or it may form a component of a more complex dispensing system, such as a sprayer system. Said tubular part has an outside smaller diameter corresponding to the diameter of said hole.

According to the present invention, it is essential that said tubular part be provided with a sealing means which ensures that said liner is pressed against the interior of said top in a leak-tight manner. The degree to which said liner needs to be pressed against the interior of said top depends mainly on physico-chemical properties of the liquid contained in the container and the compressibility of the liner material. In the absence of said sealing means, the liquid contained in the container would leak through the cap, between said liner and the interior of said top, along the contours of said hole.

There are many possible variants to provide said sealing means. The sealing means may be provided by appropriate shaping and design of the tubular part, such that, when in position, the tubular part integrally provides the sealing means. For instance, said tubular part may be provided with catches or rings adjoining the outside of said tubular part, both below said liner (hereinafter "lower" means) and above the exterior of said top (hereinafter "upper" means) which may hold said liner pressed against the interior of said top in a leak-tight manner.

Alternatively, the sealing means may be provided as a result of the physical process by which the tubular part is inserted into the hole, and held fixed in place. For example, said tubular part may be inserted by a hot-stamping or heat-sealing process such that the liner is fixed into position. The sealing means may also be provided by a mechanical clamping means, which is non-integral with the tubular part, such as a non-integral ring part.

In a preferred embodiment, said tubular part is provided with two rings (10), one below said liner and one above the exterior of said top. Compared to the catches, the rings have the advantage that they ensure an equal mechanical pressure on said liner along the periphery of said tubular part. Another advantage of using rings instead of catches is that said rings can, in turn, be provided with catches or protuberant rings or any continuous protuberances (12) which come into contact with the liner in a region adjacent to the hole, as hereinbefore described on the interior of said top, so as to increase the mechanical pressure exerted on the liner. Said lower and upper means may be of similar or different sizes and shapes, e.g. it is possible to combine catches and a ring in one embodiment, or to combine two rings of different sizes. Said means may be permanently or releasably fixed to said tubular part, or both. For instance, a tubular part can be molded which already comprises the lower means while the upper part of said tubular part comprises a threading where the upper means e.g. a threaded ring can be screwed onto said upper part of said tubular part, after said tubular part has been assembled with said liner and said body.

In a preferred embodiment of the present invention, said tubular part and said sealing means are integral, i.e. the tubular part and the sealing means are provided as a single piece, and said single piece is so dimensioned that it can be snapped onto the preassembled liner and body. In this preferred embodiment, it is advantageous to use lower and upper means with different sizes so as to facilitate the snap-on. In a preferred embodiment, the lower means is a large ring and the upper means is a smaller, bevel-edged ring, and the tubular part is snapped-on the preassembled liner and body from underneath. This embodiment allows for a fairly simple assembly of the cap while it provides a tight seal between the liner and the body.

Figure 2:
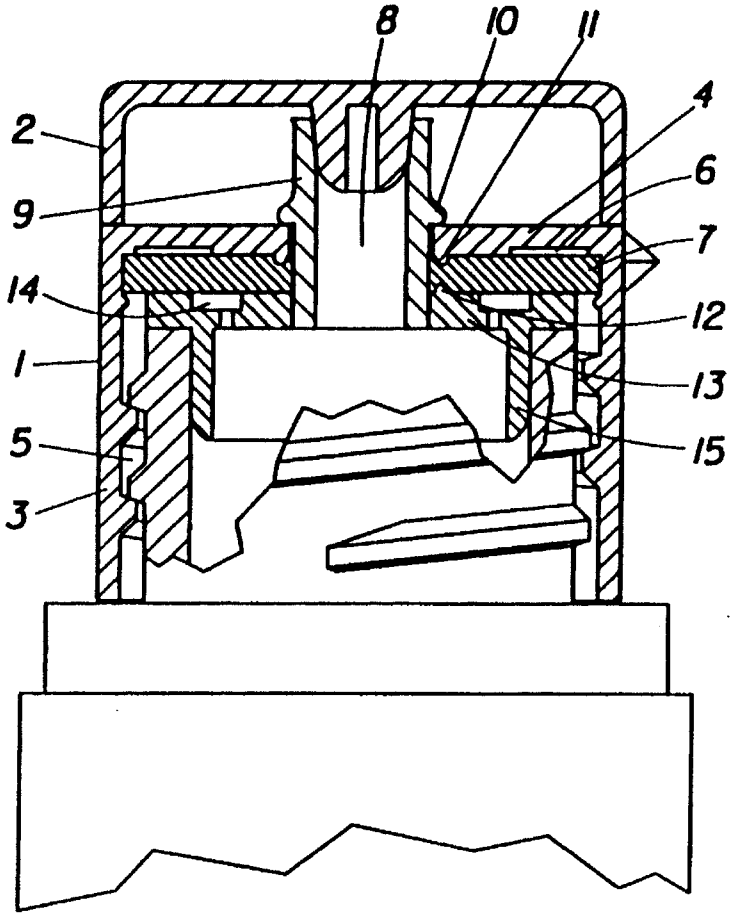
FIG. 2 is a sectioned side elevation view of an alternative cap of the present invention shown threaded onto a container.-

In a highly preferred embodiment of the present invention, and referring to FIG. 2, said lower means are constituted by a ring (13) which extends throughout the diameter of the neck of the container onto which the cap is affixed. Said ring also comprises perforations (14) so as to allow the pressure through. The advantage of such a construction is that it is said ring which forms a seal with the neck of the container when the cap is screwed onto the container, instead of the liner itself. Therefore, an equal mechanical pressure is exerted on the whole surface of the liner, and more importantly, a reproducible mechanical pressure is exerted on the liner which is almost independent from the torque generated as the cap is screwed onto the container. Consequently, the liner cannot be accidentally forced into the recesses on the interior of the top as the cap is screwed too tightly, and the venting characteristics of the cap are thus independent from said torque. In order to further improve the seal between the cap and the container, and in a further execution of this preferred embodiment, said ring comprises an adjoining side wall (15) which extends along the interior of the neck of the container.

The cap according to the present invention further comprises a closure (2). A variety of closures are available to the man skilled which are suitable for use herein, provided said closures ensure a leak-tight closure to the exterior opening of said tubular part (9). For instance, closures can be used which are screwed or snapped onto said body (1). As an alternative, closures can be used which allow the dispensing of the contained liquid as a spray. As further alternatives, said closure may be of the flip top, turret cap or push-pull type.

What is claimed is:

1. A cap for a container, said cap having a body and a closure, said body having a side wall and an adjoining top, said side wall having means to let gasses escape from said container to ambient, said top having an interior and at least one recess on said interior, said body further having an impermeable liner juxtaposed to said interior, said top and said liner being pierced by a hole, said body further having a tubular part extending through said hole, wherein a sealing means maintains said liner pressed against said interior of said top in a leak-tight manner, and wherein said closure is a flip-top closure.

2. A cap for a container, said cap having a body and a closure, said body having a side wall and an adjoining top, said side wall having means to let gasses escape from said container to ambient, said top having an interior of and at least one recess on said interior, said body further having an impermeable liner juxtaposed to said interior, said top and said liner being pierced by a hole, said body further having a tubular part extending through said hole, wherein a sealing means maintains said liner pressed against said interior of said top in a leak-tight manner, said tubular part being provided with an upper ring and a lower ring to provide said sealing means, and wherein said lower ring rests atop the neck of said container and said lower ring is provided with perforations.

3. A cap for a container, said cap having a body and a closure, said body having a side wall and an adjoining top, said side wall having means to let gasses escape from said container to ambient, said top having an interior and at least one recess on said interior, said body further having an impermeable liner juxtaposed to said interior, said top and said liner being pierced by a hole, said body further having tubular part extending through said hole, wherein a sealing means maintains said liner pressed against said interior of said top in a leak-tight manner, said tubular part being provided with an upper ring and a lower ring to provide said sealing means, and wherein said lower ring has an adjoining side wall which fits into the neck of said container.

* * * * *